US006789706B2

(12) United States Patent
Abergel et al.

(10) Patent No.: US 6,789,706 B2
(45) Date of Patent: Sep. 14, 2004

(54) INTEGRATED PUMP DISPENSER

(75) Inventors: Aline Abergel, Boulogne Billancourt (FR); Firmin Garcia, Evreux (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/362,562

(22) PCT Filed: Aug. 23, 2001

(86) PCT No.: PCT/FR01/02660

§ 371 (c)(1),
(2), (4) Date: Aug. 4, 2003

(87) PCT Pub. No.: WO02/16047

PCT Pub. Date: Feb. 28, 2002

(65) Prior Publication Data

US 2004/0011820 A1 Jan. 22, 2004

(30) Foreign Application Priority Data

Aug. 25, 2000 (FR) ..... 00 11041

(51) Int. Cl.[7] ..... B65D 37/00

(52) U.S. Cl. ..... 222/207; 222/212; 222/380; 222/494

(58) Field of Search ..... 222/207, 209, 222/212, 380, 214

(56) References Cited

U.S. PATENT DOCUMENTS 4,795,063 A * 1/1989 Sekiguchi et al. ..... 222/205
5,099,885 A * 3/1992 Nilsson ..... 222/494
5,810,203 A * 9/1998 Brennan ..... 222/494

FOREIGN PATENT DOCUMENTS

| | | |
|---|---|---|
| EP | 0 557 714 A1 | 9/1993 |
| FR | 2 510 069 A | 1/1983 |
| FR | 2 778 639 A1 | 11/1993 |

OTHER PUBLICATIONS

International Search Report for PCT/FR01/02660 dated Dec. 27, 2001.

Translation of International Preliminary Examination Report for PCT/FR01/02660 dated Sep. 4, 2002.

* cited by examiner

*Primary Examiner*—Philippe Derakshani
(74) *Attorney, Agent, or Firm*—Sughrue Mion, PLLC

(57) ABSTRACT

A fluid dispenser comprising: a reservoir (1) serving to contain fluid and defining an actuating wall (14); and a dispensing orifice (20) via which the fluid is dispensed each time the wall (14) of the reservoir (1) is actuated; the reservoir (1) further containing a pump (3) defining a pump chamber (31) provided with an inlet valve (32) for communicating with the reservoir (1) and with an outlet valve (33), the pump (3) including a pusher (34) which is pushed in order reduce the volume of the pump chamber, said pusher (34) being disposed below the actuating wall (14) of the reservoir; said dispenser being characterized in that a delivery duct (21) connects the outlet valve (33) of the pump (3) to the dispensing orifice (20).

8 Claims, 1 Drawing Sheet

INTEGRATED PUMP DISPENSER

The present invention relates to a fluid dispenser comprising a reservoir serving to contain fluid and defining an actuating wall which is pressed in order to reduce the volume of the reservoir. The dispenser further comprises a dispensing orifice via which the fluid is dispensed each time the wall of the reservoir is actuated.

Numerous dispensers of that type exist in the prior art. They are used, in particular, for pharmaceuticals, cosmetics, and perfumes. They are also to be found in the form of samples distributed free of charge for advertising purposes, and containing small quantities or "doses" of fluid. The dispenser is then in the form merely of packaging formed of a flexible reservoir provided with a dispensing orifice. The user grasps the packaging between the thumb and the forefinger and presses on the flexible walls of the reservoir to cause the fluid to be dispensed through the dispensing orifice.

Unfortunately, that type of dispenser often does not provide good dispensing quality, in particular good spraying quality, when the fluid is in the form of a liquid, such as a perfume. That is because the spraying is directly dependent on the force with which the user presses the walls of the flexible reservoir. If the user presses slowly, spraying is not good, and the fluid tends to drip out rather than being sprayed out. To mitigate that problem of dispensing quality, the dispenser described in Document FR-2 778 639 recommends imparting a predetermined resistance-to-deformation threshold to the actuating wall, it being necessary to go beyond said threshold in order to deform said wall. That actuating wall does not deform as soon as the user presses it. The user must press hard enough to overcome the resistance threshold. The actuating wall then caves in quickly and suddenly, which guarantees that the fluid stored in the reservoir of the dispenser is put under pressure immediately. The fluid is then dispensed with good spraying quality.

An object of the invention is to define another dispenser of that type, i.e. which has a reservoir having a deformable wall, and in which the fluid stored in the reservoir is dispensed in accurately metered manner and with good spraying quality.

Document U.S. Pat. No. 4,795,063 describes a dispenser comprising a flexible reservoir made up of two sheets sealed together around their peripheries. The reservoir contains a pump constituted by a base forming a piston and by a body in which the piston formed by the base is slidably received. The base also forms an inlet valve while the body forms an outlet valve. The body also forms a sealing flange to which an opening formed by one of the sheets is sealed. The base and the body are urged apart by a return spring. By bringing the base towards the body against the force exerted by the spring, the volume of the pump chamber is reduced, and fluid is delivered through the outlet valve that constitutes the dispensing orifice. The outer end of the base can be likened to a pusher, and said outer end is situated on the inside of a deformable wall of the reservoir. The outer end of the base can therefore be moved by pressing on the deformable wall of the reservoir. The fluid delivered by the pump exits from the dispenser at the outlet valve which is situated in alignment with the movement of the outer end. It is thus necessary to be careful, when actuating that dispenser, not to close off the outlet orifice with a finger, particularly since the ideal position for the finger serving as the backing finger against the thrust exerted on the outer end is the position of the outlet valve. Therefore, the fingers must be positioned beside the outlet valve so that the fluid dispensed might come into contact with the fingers, which is not the desired effect. It is thus not at all easy to use such a dispenser. This is due to the facts that the dispensing orifice is formed by the outlet valve, and that the outlet valve is situated at or opposite the deformable portion of the reservoir.

An object of the present invention is to remedy the drawbacks of that prior art.

To this end, the present invention provides a fluid dispenser comprising: a reservoir serving to contain fluid and defining an actuating wall; and a dispensing orifice via which the fluid is dispensed each time the wall of the reservoir is actuated; the reservoir further containing a pump defining a pump chamber provided with an inlet valve for communicating with the reservoir and with an outlet valve, the pump including a pusher which is pushed in order reduce the volume of the pump chamber, said pusher being disposed below the actuating wall of the reservoir; a delivery duct connecting the outlet valve of the pump to the dispensing orifice, the dispenser being characterized in that the pusher of the pump is formed by a deformable wall of the pump chamber. It may be a "diaphragm pump" in which the volume of the pump chamber is varied by a diaphragm being elastically deformed. When the diaphragm is pressed, it is deformed, and as soon as the pressure is released, said diaphragm returns to its original position. The return force of the pump is thus provided directly by the diaphragm. In addition, by offsetting the dispensing orifice relative to the pump by means of the delivery duct, the pump becomes completely invisible because it is contained entirely within the reservoir. The user believes that the dispenser is of the conventional type (without a pump). The user perceives a certain amount of resistance to deformation, imparted by the deformable wall of the pump. By continuing to press the actuating wall, a dose of fluid is dispensed: its metering and its spraying quality are guaranteed by the pump. A principle of the present invention lies in integrating the pump entirely inside conventional packaging having a deformable reservoir wall. Integrating a pump into such packaging offers other further advantages: for example, the actuating wall of the reservoir does not need to have shape memory since it is returned to its initial state by the return force of the pump that tends to return the pusher back into the rest position. The actuating wall of the reservoir may thus have a shape that is constant in the rest position regardless of the state of filling of the reservoir. In addition, the pump inside the reservoir imparts some strength to it so that it is easier for the user to take hold of it.

In a practical embodiment, the pump is fitted to a support piece defining the dispensing orifice. Advantageously, the delivery duct is formed by the support piece.

According to another characteristic, the reservoir is fixed to the support piece.

In another embodiment, the reservoir is made up of two deformable sheets sealed together around their peripheries. This is an entirely conventional design for a dispenser serving as a free sample for advertising purposes. The term "deformable sheet" should be understood as extending to film laminates and to thermoformed shells, or to a combination of both.

Advantageously, the support piece is provided with a fixing appendage to which the sheets of the reservoir are fixed, advantageously by sealing. Thus, the fixing appendage closes off the reservoir.

In a practical embodiment, the support piece forms a recess into which component members of the pump are inserted. Advantageously, the support piece defines a valve seat for the inlet valve of the pump. The support piece is thus an integral part of the pump, because said pump cannot operate without it.

The invention is described more fully below with reference to the accompanying drawings which give an embodiment of the invention by way of non-limiting example.

The fluid dispenser of the invention includes a reservoir 1 containing fluid. The reservoir 1 is formed with a deformable actuating wall 14 against which it is possible to press to deform the reservoir, thereby reducing its volume. The reservoir may be in the form of a flexible pouch made up of one or more sheets of laminated film. For example, the reservoir may be made up of a sheet of laminated film folded in half and sealed around its periphery. The reservoir may also be made up of two sheets of laminated film sealed together around their peripheries. In another embodiment, the reservoir may be formed of a shell made of a plastics material, advantageously thermoformed, and to which a closure film is sealed to form the reservoir 1. It is also possible to imagine another embodiment made up of two thermoformed shells sealed together around their peripheries. It is also possible to imagine the reservoir in the form of a flexible tube of the toothpaste tube type which is sealed at one end and which is provided with a dispensing orifice at its other end. The component material of the reservoir and its shape are therefore unimportant provided that one of the walls is deformable so as to reduce the internal volume of the reservoir.

Figure 3:
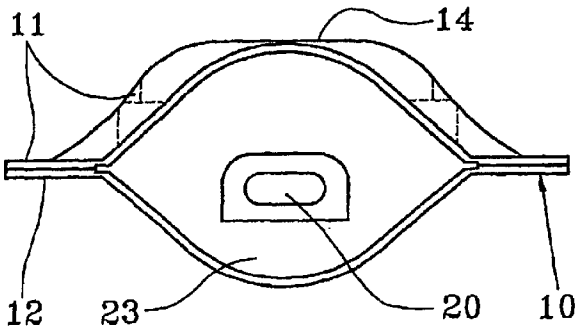
FIG. 3 is a front view of the dispenser of FIGS. 1 and 2.

In the embodiment chosen to illustrate the present invention, the reservoir is in the form of a sheet or of a deformable shell sealed around its periphery to another sheet or to another deformable shell. The actuating wall 14 is formed at the sheet or shell 11. The two sheets or shells are sealed together over their entire peripheries 10 except for the end in which a dispensing orifice 20 is formed. The dispensing orifice 20 is formed by a support piece 2 which extends from the dispensing orifice 20 towards the inside of the reservoir 1. The support piece 2 forms a fixing appendage 23, which, in this example, is a sealing appendage to which the sheets or shells 11 or 12 are sealed. As can be seen in FIG. 3, the sealing appendage 23 is diamond or eye shaped, which facilitates sealing the sheets or shells 11 and 12 to the appendage, and together at the corners of the eye formed by the appendage 23. Thus, the sealing appendage 23 closes off the reservoir 1 while forming the dispensing orifice 20 as can be seen in FIG. 3.

Advantageously, the dispensing orifice is formed at one end of an end-piece which extends into the reservoir beyond the sealing appendage 23 and which internally defines a delivery duct 21.

In the invention, the support piece 2 supports a pump 3. More precisely, the support piece 2 forms a recess 24 into which pump members are fitted, e.g. by force. In addition, the support piece 2 forms an inlet channel 22 which is separated from the delivery duct 21 by an abutment block 25. Admittedly, the support piece supports a portion of the pump, but it is also an integral part of the pump since it defines the inlet channel 22 and the delivery duct 21.

The pump 3 defines a pump chamber 31 provided with an inlet valve 32 which puts the pump chamber 31 into communication with the reservoir 1 through the inlet channel 22. The pump chamber 31 is also provided with an outlet valve 33 which puts the chamber 31 into communication with the dispensing orifice 20 through the delivery channel 21. The inlet valve 32 opens when suction is established in the pump chamber 31, and it closes when the fluid inside the chamber 31 is put under pressure. Conversely, the outlet valve 33 opens when the fluid in the pump chamber is put under pressure and closes when suction is established inside the pump chamber.

The pump is also provided with a pusher 34 which makes it possible to reduce the volume of the pump chamber 31 and thus to put the fluid contained in it under pressure.

In the invention, the pusher 34 of the pump 3 is disposed under the actuating wall 14 of the reservoir 1. Therefore, when the actuating wall 14 is pressed, the pusher 34 is also pressed, thereby actuating the pump 3. Thus, without knowing it, the user actuates the pump when pressing on the actuating wall 14. The pump is completely invisible because it is contained entirely within the reservoir 1. A metered quantity of fluid is thus dispensed with good dispensing quality. In addition, the pump 3 as secured to its support piece 3 imparts strength to the dispenser and also exerts on the actuating wall 14 the return force necessary to return the wall 14 to its initial position. The actuating wall 14 takes advantage of the return force of the pusher 34.

Figure 1:
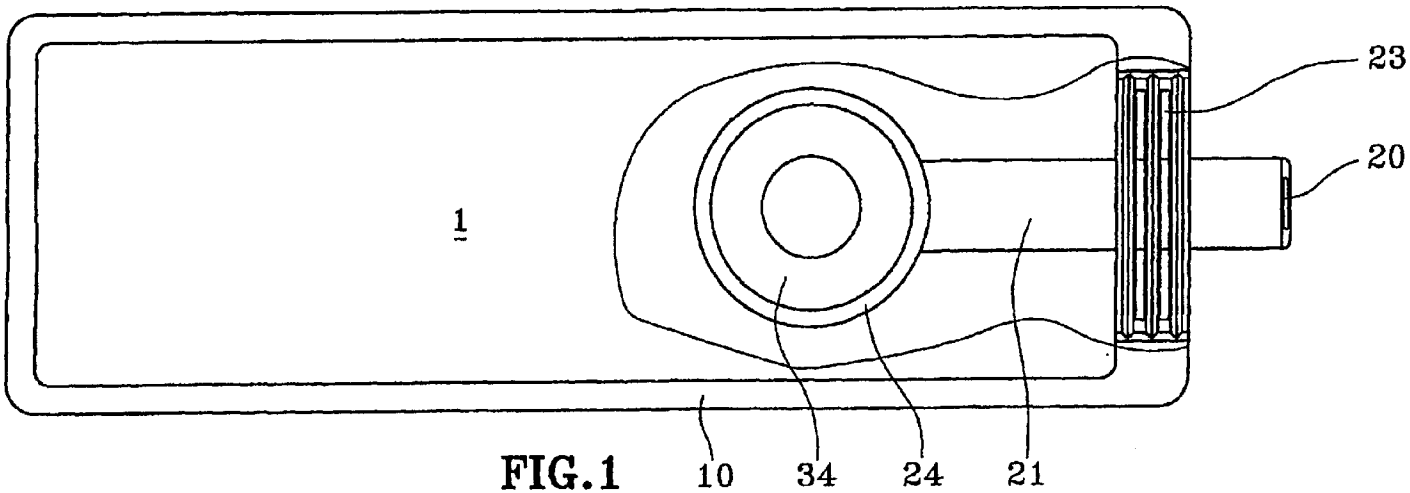
FIG. 1 is a partially cut-away plan view of a dispenser of the invention.
Figure 2:
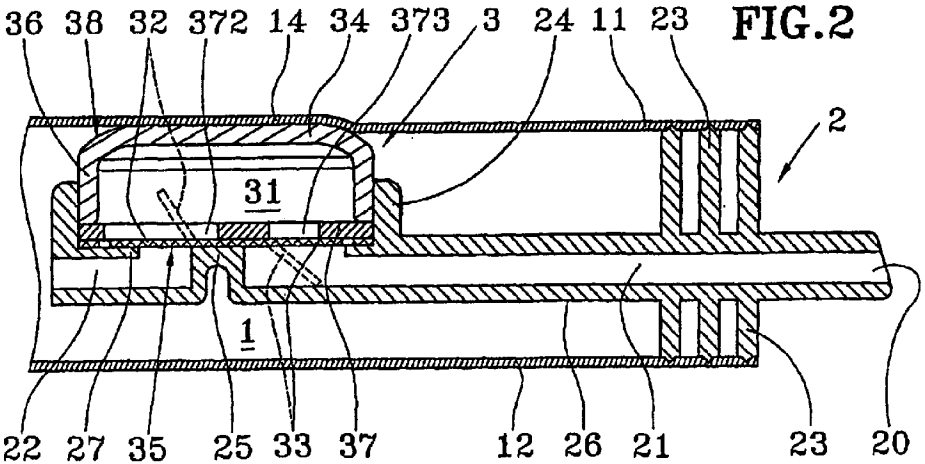
FIG. 2 is a vertical section view through the front portion of the dispenser of FIG. 1, integrating the pump.

In the embodiment shown in FIG. 2, the pump 3 is a deformable diaphragm pump. Thus, the pusher 34 is formed by a deformable wall of the pump chamber 31. The deformable wall 34 is formed by a dome-shaped piece 38 whose top portion is formed by the actuating wall 34 and whose substantially cylindrical peripheral portion 36 is engaged inside the recess 24 formed by the support piece 2. Below said dome-shaped piece 38, i.e. below the portion 36, the pump includes a plate 37 provided with two through holes 372 and 373 which are situated in register with the valves 32 and 33. A portion of the plate 37 serves as a valve seat for the outlet valve 33. Below said plate 37, the pump 3 includes a diaphragm 35 which forms the two moving valves 32 and 33. The diaphragm 35 may be in the form of a disk in which two small disks are cut out, while remaining attached to the remainder of the diaphragm. The two small disks form the two valves 32 and 33 which are capable of pivoting about the segments that connect them to the remainder of the diaphragm. The diaphragm 35 abuts against the bottom of the recess 24 which forms a flange 27 that defines the valve seat for the inlet valve 25. Furthermore, the diaphragm abuts against the block 25. By defining the inlet valve, the support piece constitutes a member of the pump, or more precisely, that portion of the support piece which forms the recess 24 is an integral part of the pump. Making provision for the support piece also to define the fixing appendage and/or the outlet orifice is merely an advantageous embodiment. In a variant, the pump, formed of its dome 38, its plate 37, its diaphragm, and its recess 24, could be fixed to a support piece that defines the outlet orifice and/or the fixing appendage. Forming the recess integrally with the support piece is merely an advantageous embodiment.

This is a non-limiting embodiment for the pump 3 integrated inside the reservoir 3. Naturally, it is possible to imagine any form of pump whose pusher can be actuated through the wall 14 of the reservoir. However, flat pumps are preferable so that the dispenser has a small thickness. The flatter the pump, the more the dispenser resembles a conventional dispenser not provided with a pump.

It should be noted that the pump 3 shown in FIG. 2 is particularly simple in design because it is made up of four component members only, namely the dome 38, the plate 37, the diaphragm 35, and the support piece, which members are very easy to manufacture. The resulting pump is particularly inexpensive. The support piece 2, which may, for example, be made of an integrally molded plastics material, is very simple to manufacture and therefore very inexpensive. It is thus possible to manufacture a dispenser serving as a free sample.

What is claimed is:

1. A fluid dispenser comprising:

a reservoir (1) serving to contain fluid and defining an actuating wall (14); and a dispensing orifice (20) via which the fluid is dispensed each time the wall (14) of the reservoir (1) is actuated;

the reservoir (1) further containing a pump (3) defining a pump chamber (31) provided with an inlet valve (32) for communicating with the reservoir (1) and with an outlet valve (33), the pump (3) including a pusher (34) which is pushed in order reduce the volume of the pump chamber, said pusher (34) being disposed below the actuating wall (14) of the reservoir; a delivery duct (21) connecting the outlet valve (33) of the pump (3) to the dispensing orifice (20), said dispenser being characterized in that the pusher of the pump (3) is formed by a deformable wall (34) of the pump chamber (31).

2. A dispenser according to claim 1, in which the dispensing orifice (20) is defined by a pump support piece (2) to which the pump (3) is fitted.

3. A dispenser according to claim 2, in which the reservoir (1) is fixed to the support piece (2).

4. A dispenser according to claim 1, in which the reservoir (1) is made up of two deformable sheets (11, 12) sealed together around their peripheries (10).

5. A dispenser according to claim 4, in which the support piece is provided with a fixing appendage (23) to which the sheets (11, 12) of the reservoir (1) are fixed, advantageously by sealing.

6. A dispenser according to claim 1 in which the pusher of the pump (3) is formed by a deformable wall (34) of the pump chamber.

7. A dispenser according to claim 1, in which the support piece (2) forms a recess (24) into which component members of the pump (3) are inserted.

8. A dispenser according to claim 2 in which the support piece (2) defines a valve seat (27) for the inlet valve (32) of the pump.

* * * * *